United States Patent [19]

Evans et al.

[11] 4,455,997

[45] Jun. 26, 1984

[54] HEATING UNIT FOR HOT TUBS AND/OR SPA UNITS

[75] Inventors: Hawley R. Evans, Fairbanks, Ak.; Charles B. Howe, King, Wash.

[73] Assignee: Snorkel Stove Co., Seattle, Wash.

[21] Appl. No.: 283,027

[22] Filed: Jul. 13, 1981

[51] Int. Cl.[3] ..... F24B 9/00

[52] U.S. Cl. ..... 126/367; 126/366; 126/368; 4/545

[58] Field of Search ..... 126/367, 366, 368, 65; 4/545

[56] References Cited

U.S. PATENT DOCUMENTS

| | | | |
|---|---|---|---|
| 394,689 | 12/1888 | Hadley | 126/367 |
| 428,124 | 5/1890 | McGowen | 126/367 |
| 430,673 | 6/1890 | Naylor | 126/367 |
| 547,038 | 10/1895 | Slowey et al. | 126/368 |
| 596,892 | 1/1898 | Lowe | 126/367 |
| 715,895 | 12/1902 | Strahm | 126/367 |
| 1,237,994 | 8/1917 | Barrett | 126/367 |
| 1,450,444 | 8/1922 | McGuire | 4/545 |
| 4,164,930 | 8/1979 | Johnston | 126/38 |
| 4,215,668 | 8/1980 | Holcombe | 126/64 |

*Primary Examiner*—Samuel Scott
*Assistant Examiner*—Noah P. Kamen
*Attorney, Agent, or Firm*—Seed and Berry

[57] ABSTRACT

A submerged heating unit fueled by wood and/or coal is disclosed for heating water in a tub or spa unit. The heating unit is composed of a single shell of a highly heat-conductive metal, such as aluminum, and has a generally L-shaped configuration in cross-section. The unit is entirely submerged in the tank of water except for air and fuel inlets and an exhaust outlet.

15 Claims, 3 Drawing Figures

FIG. 1
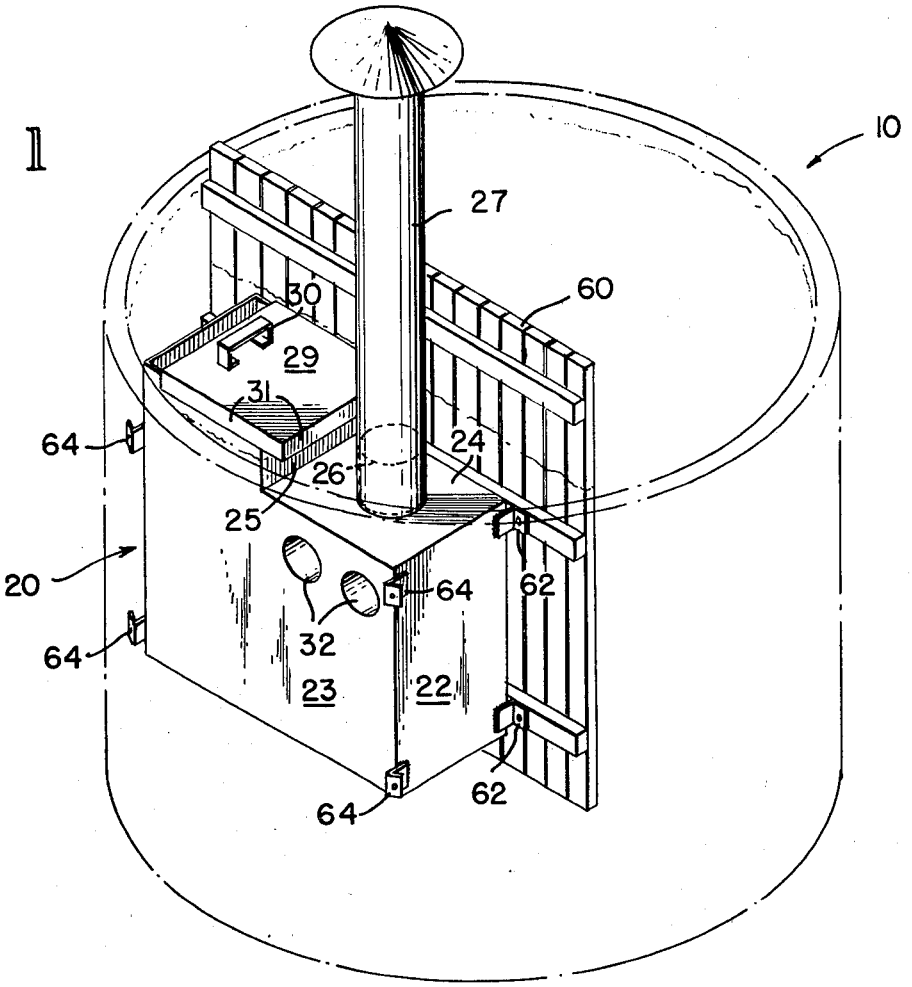
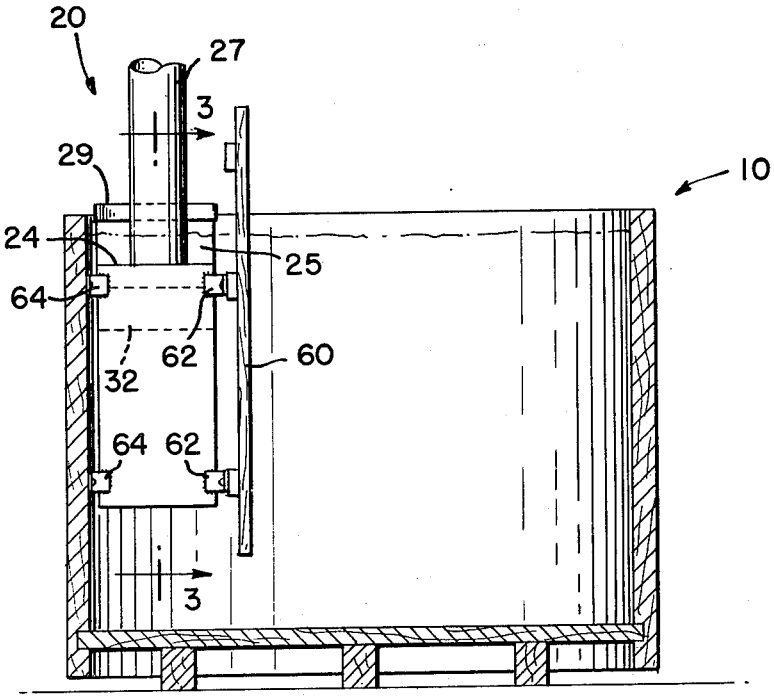
FIG. 2

HEATING UNIT FOR HOT TUBS AND/OR SPA UNITS

DESCRIPTION

TECHNICAL FIELD

This invention relates to a wood- or coal-burning heater for heating hot tubs and/or spa units.

BACKGROUND ART

Hot tubs and spa units have become a popular addition to many households. The water in these units is generally heated by natural gas or electricity. Due to the increasing cost of both sources of energy, the economics of maintaining such units has become prohibitive. At the same time, the relative abundance of wood and/or coal in many areas of the country presents a reasonable alternative to heating such units.

Heating tanks of water by direct contact of the water with the hot combustion gases or a surface heated by hot combustion gases is well known. Submerged heaters of cast iron or sheet galvanized iron for heating water in stock watering troughs to prevent freezing are described in U.S. Pat. Nos. 413,039; 414,398; 908,182; 1,237,994; 1,239,925; 1,397,831; 1,604,049; and 1,700,285. Portable bathtubs employing oil heaters are described in U.S. Pat. Nos. 2,005; 1,315,987; and 1,450,444.

DISCLOSURE OF INVENTION

It is a primary object of this invention to provide a low-maintenance, submerged, low-cost wood- and/or coal-burning unit for heating the water in hot tubs and/or spa units quickly and economically.

It is a further object of this invention to provide a submerged wood- and/or coal-burning heater having a single shell of highly heat-conductive metal, particularly aluminum, which transfers heat rapidly to the water.

It is a further object of this invention to provide a submerged heater which, in vertical cross-section, has a L-shaped configuration to serve as a firebox for the unit, the leg of the L designed to extend above the level of the water in the hot tub or spa unit for air intake while the remainder of the unit is submerged.

These and other objects are accomplished with a heater composed of a single shell having a bottom, sidewalls, a top wall at one end with an opening for connection to a stack, the other end having sidewalls extending above the level of the top wall and above the level of water in the tank in which it is submerged, the walls forming an opening for inserting wood and/or coal into the heater, and a baffle forming one wall of the opening extending downwardly over one-half the depth of the heater to define, with the outside walls of the heater, an air inlet. In vertical cross-section, the heater is L-shaped, with the leg of the L extending above the level of the water for air intake and to serve as a firebox fuel access. A wooden screen or a screen made from some other suitable material is inserted between the submerged heater unit and the wall of the hot tub in which the heater is mounted to prevent direct contact of the shell of the heater by a person.

BRIEF DESCRIPTION OF THE DRAWINGS

FIG. 1 is a perspective view of a hot tub illustrating the submerged heater unit mounted therein;

FIG. 2 is a vertical cross-section of the hot tub/heater unit combination of FIG. 1.

BEST MODE FOR CARRYING OUT THE INVENTION

Figure 3:
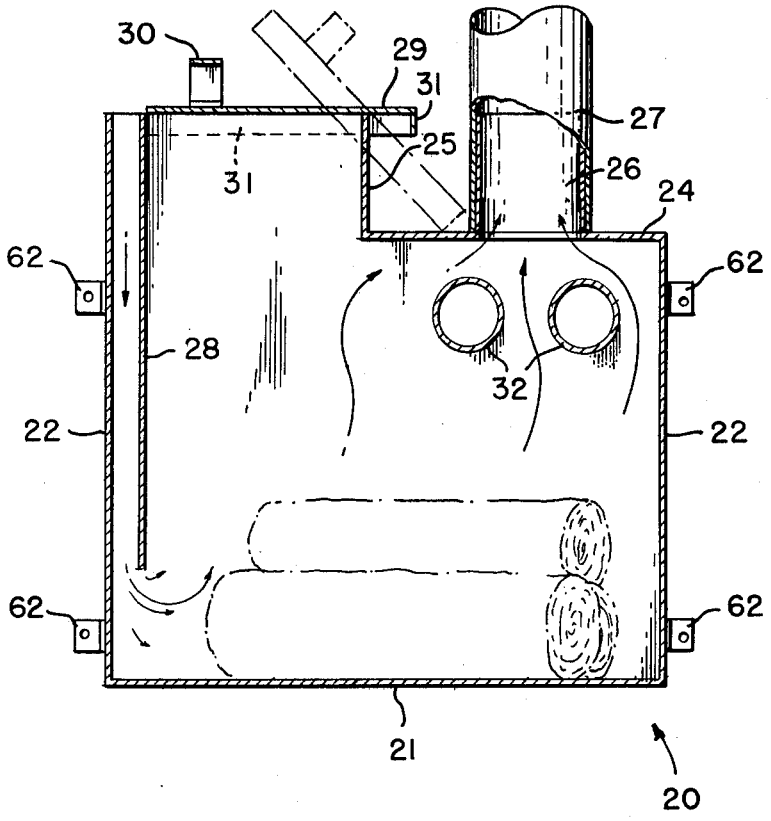
FIG. 3 is a vertical cross-section of the heater unit along section line 3—3 of FIG. 2.

FIG. 1 illustrates, in phantom, a round hot tub 10 of redwood or other suitable material having mounted therein a heater unit 20. A fence 60 of wood or other suitable screening material is mounted to one side of the heater unit to prevent direct contact of the hot metal surface of the heater unit by persons in the hot tub. The fence is fastened to L-shaped brackets 62 secured to the heater unit by suitable means. The brackets hold the unit away from the screen or fence, as shown in FIG. 2, to form a channel between the unit and the fence where water in the tub can contact the aluminum side or shell of the unit. The heater unit is fastened to the sidewall of the hot tub by use of L-shaped brackets 64. These brackets, also, hold the unit away from the sidewall of the tub, as shown in FIG. 2, to form a channel between the unit and the sidewall where water in the tub can contact the aluminum side of the unit. The heater unit 20, in vertical cross-section (as illustrated in FIG. 3), is L-shaped and is mounted to the wall of the hot tub so that the leg of the L is the only portion of the unit extending above the water level in the tub. As shown, a top wall or roof portion 24 of the unit includes a stack opening and is completely submerged in the water of the tub.

Referring to FIG. 3, the heater unit is composed of a single shell of a highly heat-conductive metal, such as aluminum. Aluminum is highly preferred because it does not rust or discolor in water and transfers heat at least three times faster than steel. Aluminum can withstand temperatures of over 1200° F., although such a temperature would never be reached with the unit completely submerged in water. Preferred is a marine grade of aluminum ranging from one-eighth to three-sixteenths inch in thickness. The unit has a flat bottom wall 21 welded to spaced pairs of sidewalls 22 and 23. At one end, the sidewalls 22 and one of the sidewalls 23 extend upwardly from the bottom wall a greater length than at the other end to provide an air intake and firebox for the unit. A top wall 24 extends parallel to the bottom wall 21 into contact with the firebox wall or lip 25. An opening (not shown) in the top wall 24 includes a flange 26, generally circular, welded to the top wall, to which a stack 27 is connected. A baffle 28, spaced a relatively short distance from the sidewall 22 at one end, extends downwardly about three-fourths the depth of the heating unit. This baffle extends laterally the entire width of the stove and provides an air intake for the unit. The heater may include a grate to hold the fuel for burning.

The firebox fuel access and air intake may be closed with a tilt-up lid 29 having a handle 30 at one end. The lid includes parallel downwardly directed flanges 31 on each side which guide opening and closing of the lid by sliding horizontally across the air intake and firebox entry. The flanges 31 abut the opposed sidewalls, as shown in FIGS. 1 and 2. A similar flange 31 may be placed on the rear side of the lid to act as a stop for the lid. By sliding the lid over the air intake, the draft of the unit can be adjusted to allow less draft for maximum efficiency or the air inlet can be completely opened for maximum heat. By pushing the lid beyond a certain distance, it tilts up (as shown in phantom in FIG. 3), allowing access to the firebox for addition of wood and/or coal. Preferably, the lid is cast aluminum with ridges to prevent warping.

Heat exchange tubes 32 extending the full width of the heating unit are included to increase the heat exchange capacity of the unit. The heat exchange tubes operate by convection. Two horizontal, substantially parallel, spaced tubes 32 are shown. They are submerged in the tub so that tub water will flow in them. The tubes 32 are substantially directly below the stack opening in the roof portion 24 of the unit, and are immediately above the combustion zone of the unit, as shown schematically in FIG. 3 by a plurality of logs on the bottom wall 21 of the unit. This combustion zone is also shown to be below the bottom end of the baffle 28.

The heating unit is mounted in a hot tub by fastening the unit to the sidewall of the tub 10, as illustrated in FIGS. 1 and 2, at a level such that when the tub is filled, the water level is above the lower port of the stack 27 and top wall 24 but below the air intake and firebox entry. The L-shape allows submerging of the hottest part of the stove near the stack to use its heat to heat water in tub. Wood is placed in the unit, which has dry, internal, aluminum surfaces, and the fire started. A grate is unnecessary, but one may be used. The sliding door or lid 29 is positioned to allow sufficient combustion air to enter the unit. The unit is almost entirely submerged so that the flames and fire in the unit contact the internal surfaces where the external surfaces are wetted by tub water, thereby keeping the aluminum from melting when the fuel burns.

The heater unit provides a number of advantages. It is unnecessary to treat and reuse the same water for months as is true with many hot tub units because it is fast and inexpensive to heat a tub of fresh water. This eliminates the need for expensive pumps, plumbing and filters. The unit can be used where no electricity is available. If desired, there is sufficient space to place a coil of copper tubing around the heater unit for preheating domestic hot water. The unit is self-contained and is easily portable.

The heat output of a heater unit such as described is about 150,000 Btu/hour into the water. In contrast, a 175,000 Btu gas heater that is eighty percent efficient will transfer 140,000 Btus into the water. Thus the unit described can raise the water temperature in a typical hot tub at a rate faster than that provided by commercially feasible natural gas or electric heaters. The table belows shows the approximate number of minutes required to raise the water temperature by 10° F. (5.5° C.) for different tub sizes. The heaters used for the test had a width of fourteen inches, a length of thirty-four inches (including the mounting brackets), a height of thirty inches, twenty-two square feet of heat transfer surface, a displacement of 5.31 cubic feet, and a weight of about fifty pounds.

TABLE

| Tub Size | Gallons | Weight | 12 KW Electric | 175,000 BTU Gas | Heating Unit Described |
|---|---|---|---|---|---|
| 5' × 3' | 332 | 2750 | 45 | 15 | 13 |
| 5' × 4' | 516 | 3980 | 63 | 20 | 18 |
| 6' × 3' | 530 | 4100 | 65 | 21 | 19 |
| 6' × 4' | 743 | 5860 | 90 | 29 | 27 |
| 7' × 3' | 720 | 5690 | 80 | 28 | 26 |
| 7' × 4' | 1010 | 8100 | | 40 | 37 |
| 8' × 4' | 1322 | 10,670 | | 52 | 48 |

The heater of this invention is a fast and economical way to heat any hot tub making use of energy resources which are readily available.

We claim:

1. A wood- or coal-burning heating unit designed to be submerged into a tank of water, comprising:

an aluminum, submersible shell having a bottom, end walls, sidewalls, a top including (1) a top wall adjacent to one end wall having a stack opening connecting to a stack, (2) an open fuel inlet for insertion of fuel into the heating unit, and (3) a lip to extend the top above the water level and to divide the top wall from the fuel inlet, the fuel inlet extending from the lip to the other end wall, a baffle spaced from the end wall of the fuel inlet and extending laterally the width of the heating unit, the baffle extending downwardly over one-half the depth of the heating unit to divide the fuel inlet and to define, in conjunction with the end wall and sidewalls of the heating unit, an air inlet, and a lid positioned over the air and fuel inlets adjustable to regulate the amount of combustion air entering the heating unit.

2. The heating unit of claim 1, including mounting brackets secured to the shell of the unit for mounting of the unit in a water tank, the brackets allowing water to flow between the tank and the shell.

3. The heating unit of claim 1 wherein a vertical cross-section of the unit is L-shaped, with the leg of the L being the sidewalls forming the air and fuel inlets, the base of the L connected to a stack and adapted to be completely submerged in the water in the tank.

4. The unit of claim 2, including at least one aluminum convection heat exchange tube extending the width of the heating unit to increase the heat exchange efficiency, the tube being positioned below the water level substantially immediately below the stack opening.

5. A quickly and economically heated hot tub unit comprising:

a water-containing tank;

a heating unit mounted within the tank for substantially complete immersion in the water when the tank is filled, the heating unit comprising a single shell of highly heat-conductive aluminum having a bottom, sidewalls, a top wall at one end with a stack, opening therein for connection to a vertical stack, the other end having sidewalls extending above the level of the top wall and above the level of water in the tank forming a fuel inlet opening for inserting wood into the unit, a baffle forming one wall of the fuel inlet opening extending downwardly over one-half the depth of the heating unit to define, in conjunction with the sidewalls, an air inlet for combustion air, and a lid positioned over the air and fuel inlets adjustable to regulate the amount of combustion air and to allow entry into the interior of the unit for addition of fuel, and a plurality of convection heat exchange tubes extending the width of the unit below the water level to increase the heat exchange efficiency of the unit; and a screen mounted between a sidewall of the heating unit and the interior of the tub to prevent direct contact by persons in the tub with the shell of the heating unit, the screen and shell defining a channel for water flow to contact the sidewall of the heating unit.

6. A submersible stove for a hot tub, comprising:

(a) an all aluminum firebox having a bottom, end walls, sidewalls, and a top, the top having an open portion adjacent one end and a closed roof portion adjacent the other end, the roof portion including a stack opening for receiving a stack pipe and being submersible in the hot tub;

(b) a baffle spanning the sidewalls near the end wall of the open portion of the top, the baffle extending downwardly at least one-half the length of the end wall to define an air inlet adjacent the end wall, a fuel inlet between the air inlet and the roof portion, and a combustion zone below the baffle in the firebox where the air and fuel can mix, the combustion zone being essentially directly below the roof portion;

(c) mounting brackets for mounting the firebox in the tub to allow water to contact the firebox over substantially the entire surface of the combustion zone to cool the aluminum sufficiently to allow its use for the bottom, end walls, sidewalls, and roof portion; and (d) a lid for covering the open portion of the firebox to leave the stack opening as the only outlet for combustion gases created in the stove.

7. The stove of claim 6, further comprising at least one aluminum heat exchange tube extending through the combustion zone and being submersible in the tub, the tube increasing the heat exchange efficiency for the stove.

8. The stove of claim 7 wherein the tube spans between the sidewalls in the area immediately below the stack opening on the roof portion.

9. The stove of claim 8, further including a second tube spanning the sidewalls substantially parallel to the first tube but horizontally spaced from the first tube.

10. A hot tub comprising:

(a) a water tank;

(b) a stove as defined in claim 6;

(c) a screen to segregate the tub into a bathing section and a water-heating section; and (d) screen brackets to mount the screen to the stove, the brackets allowing water to contact the stove in a channel formed between the stove and the screen.

11. The hot tub of claim 10 wherein the tub is wood-lined and the screen is wood.

12. A submersible stove for a hot tub or water tank, comprising a firebox made of aluminum on all surfaces which will be submerged during firing of the stove, the stove having an air inlet, a fuel inlet, a lid to cover the fuel and air inlets, and a stack opening connectible to a stackpipe to allow combustion gases to leave the stove, wherein the aluminum surfaces of the stove are continually cooled by the surrounding water during firing of the stove by having the water directly contact the aluminum surfaces.

13. The stove of claim 6 wherein the lid is made from cast aluminum.

14. The stove of claim 13 wherein the lid includes downwardly depending flanges at its sides to abut the opposed sidewalls, wherein the flanges serve as guides for sliding the top over the air and fuel inlets.

15. A method for heating water in a hot tub, comprising the steps of:

(a) positioning an aluminum firebox in a hot tub so that water in the hot tub wets the aluminum surfaces of the firebox over all but the air and fuel inlet and stack which project upwardly from the water; and (b) burning solid fuel in the firebox so that the flames contact the dry, internal, aluminum surfaces of the firebox where the external surfaces are wetted by hot tub water.

* * * * *